United States Patent [19]

Goyne

[11] 4,342,537

[45] Aug. 3, 1982

[54] IMPELLER PUMP AND SEAL

[76] Inventor: Thomas S. Goyne, 37 S. Ninth St., Ashland, Pa. 17921

[21] Appl. No.: 138,863

[22] Filed: Apr. 8, 1980

[51] Int. Cl.[3] ..... F04D 29/10

[52] U.S. Cl. ..... 415/170 A; 415/175

[58] Field of Search ..... 415/170 R, 170 A, 175, 415/176, 180

[56] References Cited

U.S. PATENT DOCUMENTS

| | | | |
|---|---|---|---|
| 2,741,991 | 4/1956 | Disbrow | 415/180 X |
| 3,516,759 | 6/1970 | Haentjens | 415/176 |
| 3,552,875 | 1/1971 | Bond | 415/175 |
| 3,609,058 | 9/1971 | Tarsoly | 415/180 X |
| 3,954,348 | 5/1976 | Renaud | 415/175 X |
| 4,179,247 | 12/1979 | Osborn | 415/170 R X |

*Primary Examiner*—Everette A. Powell, Jr.

*Attorney, Agent, or Firm*—Buell, Blenko, Ziesenheim & Beck

[57] ABSTRACT

A centrifugal pump is provided having a housing, a pump chamber in said housing, a pumping impeller in said pump chamber, a rotatable shaft extending through said housing into said chamber carrying said impeller, a packing box in said housing surrounding the rotatable shaft adjacent the pump chamber, a rotatable sleeve removably fixed on said shaft extending from said impeller through said packing box and rotating with said shaft, a stationary sleeve in said housing extending from said packing box to a point adjacent said impeller and surrounding a portion of said rotatable sleeve between said packing box and impeller, packing means in said packing box surrounding said rotatable sleeve, said packing box being surrounded by a liquid being pumped by said impeller over a major portion of its outer surface, and a continuous pressure lubricant source connected to said packing box supplying continuous lubrication between the rotatable sleeve and stationary sleeve.

16 Claims, 4 Drawing Figures

IMPELLER PUMP AND SEAL

This invention relates to impeller pumps and particularly to grease seal and bearing structures in semi-open horizontal impeller pumps.

Semi-open horizontal impeller pumps are used in a variety of circumstances and for a variety of purposes. One of the principal uses of such pumps is in slurry pumping in mining, dredging and similar operations. One of the problems in such pumps is the need to prevent leaking of slurry into the pump packing and bearings and to prevent air from entering the pumps. Pump manufacturers have, in the past, resorted to a variety of devices in an effort to solve these problems but without real and total success. One form of such pump is a side suction pump as illustrated in U.S. Pat. No. 2,581,504 that operates with suction on the area requiring sealing. In the suction area of this pump, where a packing box would ordinarily be located, an auxiliary impeller is used. This auxiliary impeller is arranged to pump from the atmosphere side toward the pump liquid end. The suction pressure from the sump reaches the sealing impeller and, if the impeller speed is correct, there will be no leakage. If the pump suction pressure is greater than the generated head of the sealing impeller there will be leakage to atmosphere. Conversely, if the sealing impellers generated head is greater than the sump suction pressure, than air will be pumped into the main pump. Air is destructive to such a pump and cannot be tolerated. The procedure followed in using such pumps is to bring the pumps up to the speed required to do the work and then adjust the sump level to the elevation where the sump suction pressure and the pressure generated by the sealing impeller are equal. Another form of pump is an end suction pump having outside pumping vanes on each shroud designed to prevent excessive pressure on the packing area. This form of pump, which is illustrated in U.S. Pat. No. 3,146,722 uses a packing box and a small impeller between the packing box and liquid end of the pump designed to baffle any pressure from the main pump area from reaching the packing box and also to pump grease from the packing box into the area between the impeller and main pump. The grease between the impeller and main pump is intended to stop the flow of slurry toward the packing when the pump is stopped. Unfortunately the impeller does not always generate measurable pressure and back flow to the packing results.

I have invented a pump structure which not only eliminates these problems but provides added support for the driving shaft and bearing and permits higher pump speeds. My invention can be used in both side suction and end suction pumps of the type discussed above with the elimination of the inner impellers used only to protect the packing. Since side suction pumps are the most commonly used pump for slurry handling I shall illustrate and describe my invention in the context of a side suction pump, however, it can be similarly utilized in end suction pumps.

I provide a centrifugal pump housing, a pump housing, a pump chamber in said housing, a pumping impeller in the pump chamber, a rotatable shaft extending into said chamber carrying said impeller, a packing box in said housing surrounding the rotatable shaft adjacent the pump chamber, a rotatable sleeve removably fixed on said shaft extending through said packing box to said impeller and rotating with said shaft, a stationary sleeve in said housing extending from said packing box to a point adjacent said impeller and surrounding a portion of said rotatable sleeve between the packing box and impeller, packing means in said packing box surrounding said rotatable sleeve, said packing box being surrounded by a liquid being pumped by said impeller over a majority of its area, and a continuous pressure lubricant source supplying continuous lubrication between the rotatable sleeve and stationary sleeve. (Preferably the source of continuous pressure lubricant is a low volume positive displacement grease pump supplying grease at a pressure that will always be greater than the back pressure from the main pump. An operating positive displacement pump, fully powered, will always baffle any back pressure that the slurry pump can exert toward the packing area.) Preferably the stationary sleeve is supported at least adjacent each end, preferably at the packing box and at a point adjacent the impeller. The packing means may be any conventional packing material or it might be a so called mechanical shaft seal such as a "syntron RP" type mechanical seal. When such a mechanical seal is provided. I preferably provide a source of circulating cooling fluid in the packing box separate from the pressurized grease.

In the foregoing general description I have set out certain objects, purposes and advantages of my invention. Other objects, purposes and advantages of this invention will be apparent from a consideration of the following description and the accompanying drawings in which.

Figure 2:
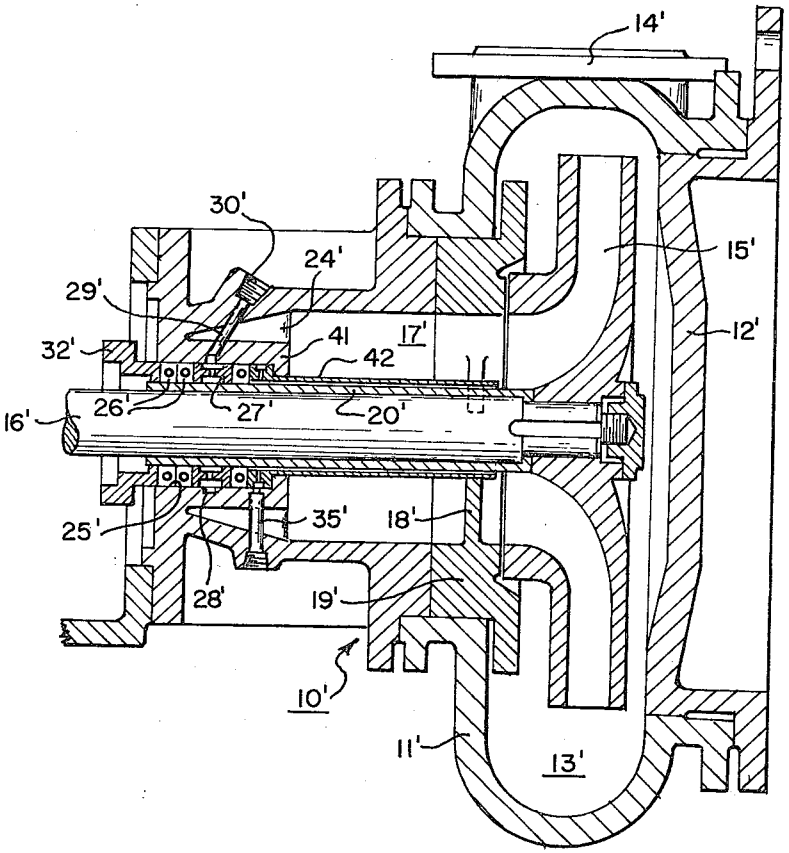
FIG. 2 is a longitudinal section through a second embodiment of pump according to my invention.

Referring to the drawings I have illustrated a pump housing 10 which is made up of a volute casing 11 having an end closure 12 which forms a pumping chamber 13 opening to a discharge collar 14. An impeller 15 mounted on the end of shaft 16 is rotatable in chamber 13. The suction side of impeller 15 is open to a suction chamber 17 between three radial control and support ribs 18 on casing ring 19 of housing 10. Shaft 16 is surrounded by a sleeve 20 fixed thereto and rotatable therewith over the portion of the shaft within housing 10. A combined packing box 21 and stationary sleeve 22 surrounds the sleeve 20, with sleeve 22 in close bearing contact with sleeve 20 and with the end of sleeve 22 remote from the packing box 21 being supported by radial ribs 18. Packing box portion 21 is in turn supported by radial ribs 24 in suction chamber 17 so that the major portion of the exterior of the packing box 21 and sleeve 22 are in contact with and cooled by liquid being pumped through the suction chamber. Annular packing chamber 25 in packing box 21 is provided with packing 26 separated by spacer 27 which spacer is preferably a lantern ring or packing seal ring of conventional design and is surrounded by annular lubricant groove 28 in packing box 21. Groove 28 is connected by line 29 to grease inlet 30 which is connected to a gear pump 31 driven through a reducer and drive motor to supply lubricant under continuous pressure into the interior of the packing box 21 and sleeve 22 to lubricate sleeves 20 and 22 and to prevent entry of the pumped liquid or slurry into the area between sleeves 20 and 22.

A gland 32 threaded into the end of packing box 21 surrounds shaft 16 to pressurized packing 26. A pre-greasing passage 35 is provided in housing 10 communicating with the packing chamber 25 whereby the packing box 21 and sleeve 22 can be pre-loaded with grease after manufacture and prior to shipping and if necessary may be manually greased during operation.

In the embodiment illustrated in FIG. 2 I have illustrated a modification of my invention in which the packing box 41 is formed integral with housing 10' and sleeve 42 is a separate member inserted in the packing box and supported at its remote end by control and support ribs 18'. The structure is otherwise the same as in FIG. 1 and those parts which are the same bear like members with a prime sign. In this particular embodiment I have illustrated a spherical inner groove 43 in sleeve 42 to aid in carrying lubricant along sleeve 42. Such a groove may be used in any of the embodiments here illustrated and described.

Figure 1:
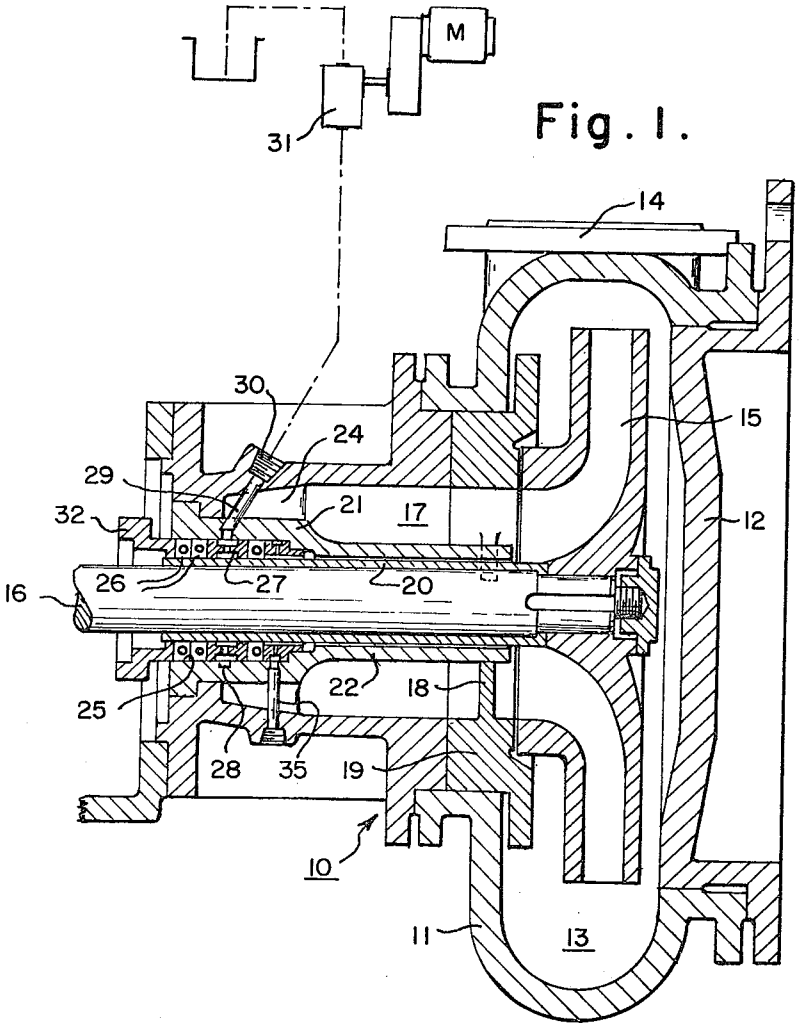
FIG. 1 is a longitudinal section through a side suction pump according to one embodiment of this invention.
Figure 3:
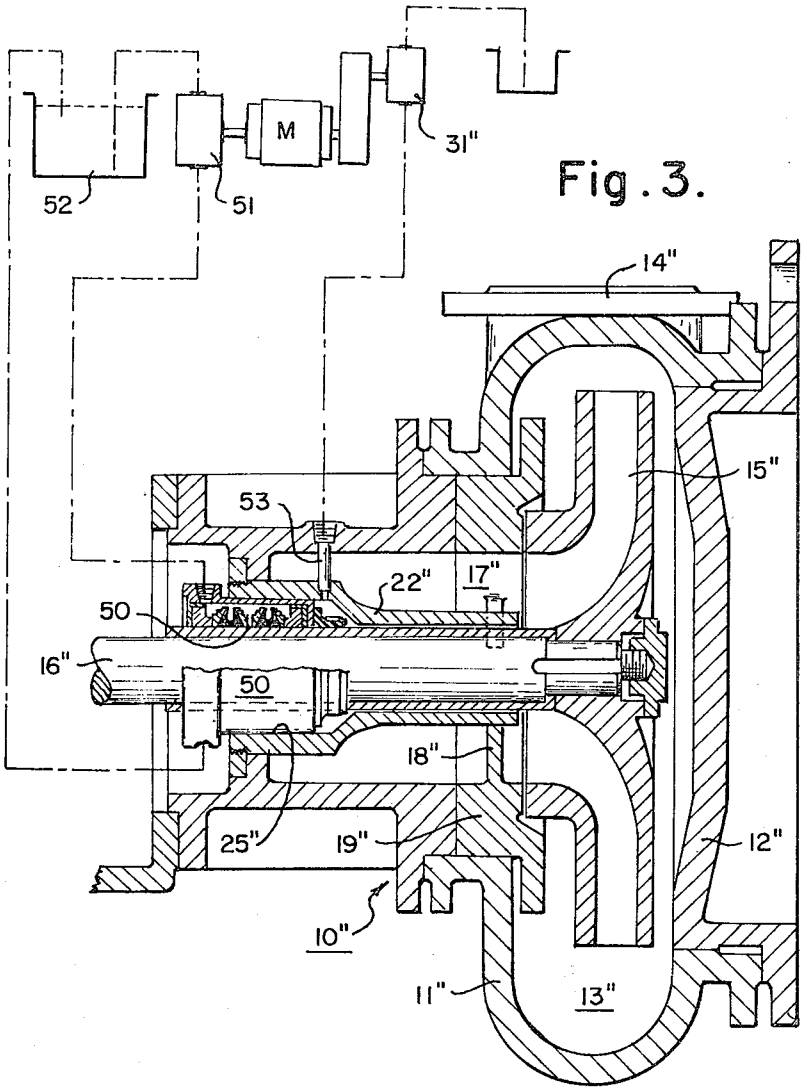
FIG. 3 is a longitudinal section through a third embodiment of pump according to my invention.
Figure 4:
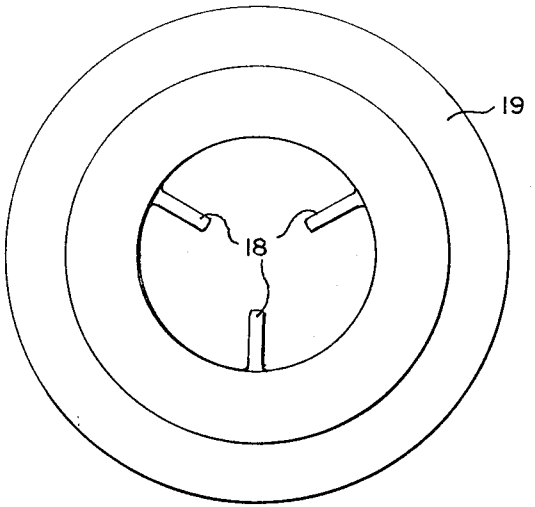
FIG. 4 is a front elevational view of one embodiment of casing ring used in all of the embodiments.

FIG. 3 is identical with FIG. 1 except that a mechanical shaft seal 50 of the "Syntron RP" type is a substitute for packing 26 in packing chamber 25 and a second gear pump 51 connected to chamber 25 is provided for circuating coolant from reservoir 52 through chamber 25 to cool the mechanical seal and a continuous pressure lubricant pass age 53 in place of passage 29 connects to the packing box chamber at the junction with sleeve 22''. All other like parts bear numbers corresponding to those of FIG. 1 with a double prime sign.

The structure of the present invention is highly advantageous over prior art devices. The packing box is cooled and therefore there is less wear and damage on the two sleeves. The seal is far superior and the lubrication of the parts far better than prior art structure. Finally the pump can be operated at about 50% greater speed than conventional pumps because of the greater support provided for the shaft as well as improved lubrication, cooling and sealing.

In the foregoing specification I have set out certain preferred embodiments and practices of this invention, however, it will be understood that this invention may be otherwise embodied within the scope of the following claims.

I claim:

1. A centrifugal pump comprising a housing, a pump chamber in said housing, a pumping impeller in said pump chamber, a rotatable shaft extending through said housing into said chamber carrying said impeller, a packing box in said housing surrounding the rotatable shaft adjacent the pump chamber, a rotatable sleeve removably fixed on said shaft extending from said impeller through said packing box and rotating with said shaft, a stationary sleeve in said housing connected to said packing box and extending from said packing box to a point adjacent said impeller and surrounding a portion of said rotatable sleeve between said packing box and impeller, packing means in said packing box surrounding said rotatable sleeve, said packing box and stationary sleeve being surrounded by a liquid being pumped by said impeller over a major portion of its outer surface, and a displacement type lubricant source connected to said packing box supplying continuous lubrication into at least a portion of said packing box and between the rotatable sleeve and stationary sleeve.

2. A centrifugal pump as claimed in claim 1 wherein said continuous pressure lubricant source is a low speed gear pump supplying lubricant at a pressure that is always greater than the pressure in the pump chamber.

3. A centrifugal pump as claimed in claim 1 wherein one of the stationary sleeve and the rotary sleeve is provided with a spiral groove from end to end.

4. A centrifugal pump as claimed in claim 1 wherein said pump chamber includes a casing ring having an annular central opening surrounding and spaced from the stationary sleeve and at least three substantially equally spaced radial control and support ribs extending from the casing ring to said stationary sleeve to support the same.

5. A centrifugal pump as claimed in claim 1 or 2 or 3 or 4 wherein the packing box and stationary sleeve are a unitary assembly received in an opening in said housing and said packing box is held against transverse movement by a plurality of ribs in said housing.

6. A centrifugal pump as claimed in claim 1 or 2 or 3 or 4 wherein the packing box is integral with the housing and the stationary sleeve is held in an opening in said packing box.

7. A centrifugal pump as claimed in claim 1 or 2 or 3 or 4 wherein the packing box and stationary sleeve are a unitary assembly fitted in a counter bore in the housing around said shaft.

8. A centrifugal pump as claimed in claim 5 having a suction chamber surrounding at least a portion of said packing box and stationary sleeve.

9. A centrifugal pump as claimed in claim 6 having a suction chamber surrounding at least a portion of said packing box and stationary sleeve.

10. A centrifugal pump as claimed in claim 7 having a suction chamber surrounding at least a portion of said packing box and stationary sleeve.

11. A centrifugal pump as claimed in claim 5 having a packing material in said packing box.

12. A centrifugal pump as claimed in claim 5 having a mechanical seal in a portion of said packing box and means connected to said packing box circulating coolant therein.

13. A centrifugal pump as claimed in claim 6 having a packing material in said packing box.

14. A centrifugal pump as claimed in claim 6 having a mechanical seal in said packing box and means connected to said packing box circulating coolant therein.

15. A centrifugal pump as claimed in claim 7 having a packing material in said packing box.

16. A centrifugal pump as claimed in claim 7 having a mechanical seal in said packing box and means connected to said packing box circulating coolant therein.

* * * * *